United States Patent [19]

Megrditchian

[11] Patent Number: 4,726,197

[45] Date of Patent: Feb. 23, 1988

[54] APPARATUS FOR TREATING AIR

[76] Inventor: Dennis L. Megrditchian, 4657 N. Harrison, Fresno, Calif. 93704

[21] Appl. No.: 926,207

[22] Filed: Nov. 3, 1986

[51] Int. Cl.[4] ..... F25D 17/04

[52] U.S. Cl. ..... 62/309; 62/409; 62/412

[58] Field of Search ..... 62/171, 304, 309, 314, 62/315, 316, 91, 121, 409, 411, 412, 325

[56] References Cited

U.S. PATENT DOCUMENTS

| | | | |
|---|---|---|---|
| 1,409,520 | 3/1922 | Bird | 165/64 |
| 1,510,340 | 9/1924 | Pauls | 62/95 |
| 1,962,572 | 6/1934 | Richardson | 62/176 |
| 1,986,529 | 1/1935 | Ray | 62/314 X |
| 2,118,949 | 5/1938 | Scott | 62/412 X |
| 2,144,169 | 1/1939 | Turner | 62/171 X |
| 2,401,560 | 6/1946 | Graham et al. | 62/325 X |
| 2,464,766 | 3/1949 | Pennington | 62/139 |
| 2,499,411 | 3/1950 | Pennington | 62/6 |
| 2,527,569 | 10/1950 | Pennington | 62/139 |
| 2,576,140 | 11/1951 | Pennington | 62/139 |
| 2,655,795 | 10/1953 | Dyer | 62/4 |
| 2,723,837 | 11/1955 | Pennington | 257/3 |
| 3,042,383 | 7/1962 | Pennington | 257/281 |
| 3,833,052 | 9/1974 | Cardinal | 165/20 |
| 3,905,205 | 9/1975 | Zusmanovich | 62/309 |
| 4,284,128 | 8/1981 | Nelson | 165/48 R |
| 4,361,525 | 11/1982 | Leyland | 261/152 |
| 4,380,910 | 4/1983 | Hood et al. | 62/304 X |
| 4,520,864 | 6/1985 | Katagiri et al. | 165/60 |
| 4,537,035 | 8/1985 | Stiles | 62/89 |

FOREIGN PATENT DOCUMENTS 57-21730 4/1982 Japan .

OTHER PUBLICATIONS

Watt, J. R., *Evaporative Air Conditioning,* The Industrial Press, New York, N.Y., 1963, pp. 227–231.

Advertising brochure for the Master Cool Evaporative Cooler.

Extract from Air Conditioning, Heating & Refrigeration News, p. 9, dated Mar. 4, 1985.

Advertising brochure for the Vari-Cool Dry Air Evaporative Cooler.

Advertising brochure for the Mastercool 2-Stage Evaporative Cooler.

Advertising brochure for the Norsaire Systems Compound Evaporative Air Conditioning Systems.

Advertising brochure for the Energy Master Indirect Evaporative Conditioning System.

*Primary Examiner*—Harry B. Tanner

*Attorney, Agent, or Firm*—Worrel & Worrel

[57] ABSTRACT

An apparatus for treating air having a housing with a passageway extending therethrough for interconnecting a source of the air and a space to be conditioned; two air movers mounted in the housing for creating two reduced pressure zones internally of the chamber; a pivotally positionable damper mounted in the passageway for selectively directing air received from the source along predetermined paths of travel internally of the chamber; and a counter-flow heat exchanger and cooling pad mounted in predetermined positions in the path of travel extending to the space to be conditioned to absorb heat energy and evaporatively cool the air passing to the space to be conditioned.

20 Claims, 7 Drawing Figures

APPARATUS FOR TREATING AIR

BACKGROUND OF THE INVENTION

1. Field of the Invention

The present invention relates to apparatus for treating air in an evaporative cooler or the like and more particularly to such an apparatus which is unusually well suited to producing a volume of treated air having a selected dry and wet bulb temperature; and which further has a component configuration which permits the apparatus to utilize outside ambient air for cooling and return air for pre-cooling, or alternatively for heating; the apparatus acquiring a variety of noteworthy performance characteristics by mounting its associated components in a configuration which is compact, lightweight, and energy efficient.

2. Description of the Prior Art

The beneficial effects of employing evaporative cooling for the purpose of reducing the temperature of an ambient airstream has been known for some time. The evaporative cooling technique is usually employed, with good success, in a number of specific environments. More particularly, evaporative cooling has been used occasionally for the air cooling of machines where higher humidities can be tolerated; for the cooling of industrial areas where high humidities are required, such as in textile mills; and for comfort cooling in hot, dry climates, where the partial saturation of the ambient airstream results in the production of cool air at acceptable humidities.

It is well understood that evaporative cooling takes place when non-saturated ambient air is mixed with a source of water. During this mixture process, a portion of the ambient airstream's sensible heat transfers from the air to the evaporating water; the sensible heat which has been transferred then returns to the airstream as the latent heat of water vapor. The foregoing exchange of heat energy is thermally isolated, or adiabatic, and continues until the ambient airstream is saturated with water vapor and the air and water temperatures are equal. With a suitable apparatus, the air temperature of the ambient airstream approaches within a few degrees of the theoretical limit, i.e. the wet bulb temperature. In its most simplistic form, evaporative cooling is carried out by blowing relatively dry, warm air through a wet mat.

Although direct evaporative cooling is quite effective in providing comfort cooling in warm, dry climates, it becomes less effective as the dry bulb and therefore the wet bulb temperature increases. It has long been known that the sensible pre-cooling of the relatively dry air by means of indirect evaporative cooling before passing it into a direct evaporative cooling process extends the theoretical potential of evaporative cooling below the ambient airstreams wet bulb temperature. The employment of an apparatus which pre-cools the relatively dry airstream before the direct evaporative cooling process makes evaporative cooling much more competitive with refrigeration type air conditioning by providing substantially the same comfort level while utilizing far less power.

The prior art is replete with examples of evaporative cooling devices which employ the technique of pre-cooling the ambient airstream prior to subjecting it to direct evaporative cooling. However, such prior art devices have suffered from several chronic problems which have prevented their being widely accepted for common usage. A lack of cooling capacity; inefficiency; and unusually large physical sizes have been the primary impediments. These problems are compounded in evaporative cooling devices which have been developed for use in a residential environment inasmuch as the systems that are currently available, do not appear to balance the practical needs of the structure and the interrelated parameters of efficiency; cooling capacity; physical size; and cost in an apparatus which is capable of both heating and cooling the structure. Although evaporative cooling systems can be found which will meet or exceed any specific parameter listed above, it is highly probable that such a system may become totally unacceptable for a major segment of the market due in large measure to technical compromises which must be made to reach the desired performance characteristic. For example, an analysis of the prior art systems reveals that where a plurality of heat exchangers are deployed or assembled in sequence for the purpose of pre-cooling a stream of ambient air, they are often positioned with little regard for the additional marginal cooling effect which they may individually contribute. As a result, there is often a significant pressure drop between the additional heat exchangers, thus requiring the utilization of larger horsepower air movers to maintain the effectiveness of the evaporative cooler and to control the pressure drop.

Another chronic difficulty encountered in prior art evaporative cooling devices which have been adapted for industrial or residential use is that they nearly all lack an efficient heating system or means for conveniently shifting from the use of outside ambient air, and return air for pre-cooling, to the exclusive use of return air for heating.

Still another problem encountered in prior art evaporative cooling devices which have been designed for industrial or residential use is the propensity for these apparatuses to move large volumes of ambient air through relatively small cross-sectional areas; or to urge the ambient air through various flow area changes, or turns in the apparatus. These prior art arrangements cause severe pressure drops in the air flow.

Therefore, it has long been known that it would be desirable to have an improved apparatus for treating air which could be employed in a wide variety of different environments; which could be manufactured and purchased at moderate cost; which is both highly efficient in operation and is compact; and which simultaneously reduces to an absolute minimum the assorted problems associated with evaporative or other types of coolers.

SUMMARY OF THE INVENTION

Therefore, it is an object of the present invention to provide an improved apparatus for treating air.

Another object is to provide such an apparatus which has particular utility in operation in conjunction with evaporative cooling.

Another object is to provide such an apparatus which is operable to obtain the individual benefits to be derived from prior art evaporating cooling devices while avoiding the detriments individually associated therewith.

Another object is to provide such an apparatus which is operable to reduce to a minimum the overall cost of cooling a predetermined volume of ambient air.

Another object is to provide such an apparatus which is particularly well suited to utilizing outside ambient air for cooling, and return air for pre-cooling, or alternatively for heating.

Another object is to provide such an apparatus which is of moderate cost to purchase and maintain and which consumes relatively low amounts of energy per volume of ambient air treated in the evaporative cooling process.

Another object is to provide such an apparatus which can be adapted to incorporate conventional refrigeration technology for the purpose of extending the operational climatic range of the evaporative cooling apparatus.

Another object is to provide such an apparatus which is operable to treat a stream of ambient air rapidly, dependably, and efficiently, while reducing to an absolute minimum any associated maintenance time.

Another object is to provide such an apparatus which is characterized by an ease of installation, simplicity of construction and which can be sold at a relatively moderate price.

Further objects and advantages are to provide improved elements and arrangements thereof in an apparatus for the purposes described which is dependable, economical, durable, and fully effective in accomplishing its intended purposes.

These and other objects and advantages are achieved in an apparatus for treating air possessing a housing having a conduit disposed transversely of the housing's longitudinal axis; the conduit mounting a pivotally positionable damper which is operable selectively to direct a source of ambient air along any one of a plurality of predetermined paths of travel and further having a plurality of air movers to create at least two reduced pressure zones internally of the housing to urge the source of ambient air to enter the housing and pass along the selected path of travel to absorb heat energy and evaporatively cool the ambient air, or alternatively to impart heat energy to the ambient air in the reduced pressure zones to produce a volume of treated air having a selected temperature.

DESCRIPTION OF THE PREFERRED EMBODIMENT

Figure 1:
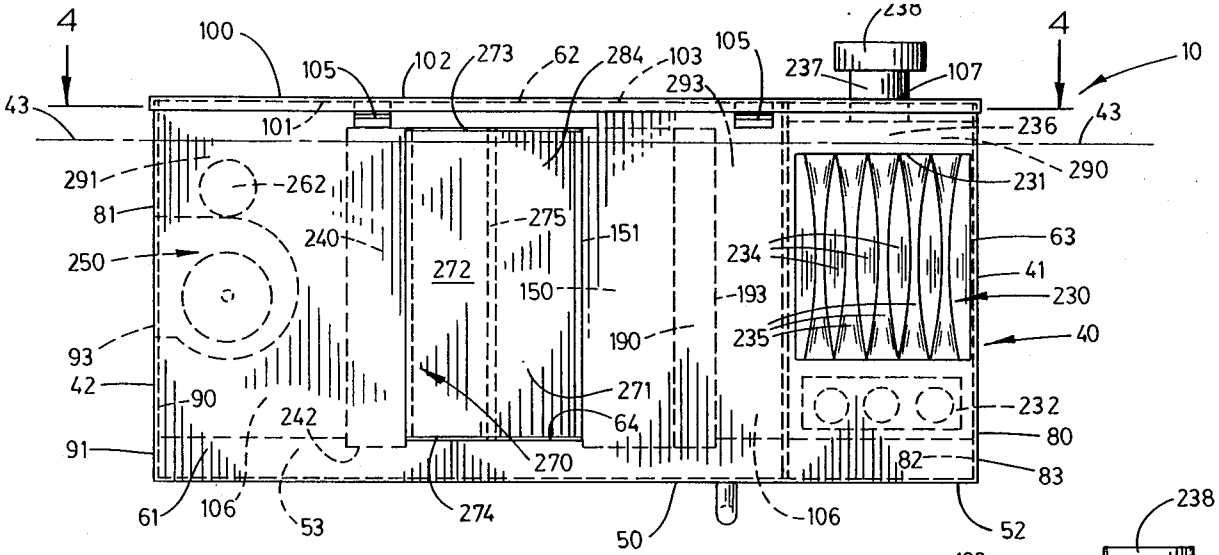
FIG. 1 is a front elevation of the apparatus of the present invention showing the pivotally positionable damper assembly in the cooling position.

Referring more particularly to the drawings, the apparatus for treating air of the present invention is generally indicated by the numeral 10 in FIG. 1.

For illustrative convenience, the apparatus as shown and described herein is discussed as it would be configured if it were installed on a supporting surface such as the roof of a house or the like.

As will hereinafter thus be described in greater detail, the apparatus 10 is adapted to change the energy level of ambient air 11 which is thereafter supplied to a space to be conditioned, hereinafter referred to as the conditioned space, in a structure which is to be serviced such as a home 12.

As best illustrated by reference to FIGS. 2 and 3, the apparatus 10 is mounted on the home 12 which has the conditioned space. The home has a roof 13 which is suitably covered with a multiplicity of shakes 14 or other suitable roof covering. The shakes define a supporting surface 15. Formed in the roof, in a location closely adjacent to the apparatus, is a first air duct passageway 20 which extends through the roof and communicates with the conditioned space internally of the home. The first air duct passageway slidably receives in sealably secure mating relation a substantially rectangular discharge air duct 21 that is interconnected in fluid-flow relation with the exhaust port of the apparatus, as will be hereinafter described in greater detail. The discharge air duct 21 defines a lumen 22 which receives the ambient air 11 which has been treated by the apparatus, and which channels the ambient air in a direction that is indicated by the arrow in FIG. 2. Formed in the roof, in a position adjacent to the first air duct passageway, is a second air duct passageway 23. The second air duct passageway slidably receives in sealably secure mating relation a substantially rectangular return air duct 24. It should be understood that the return air duct 24 defines a lumen 25 which interconnects, in fluid-flow relation, the conditioned air space and the apparatus 10. The return air duct receives and channels the previously treated ambient air in a path of movement as indicated by the arrow in FIG. 3.

The apparatus 10 is deployed in an appropriate attitude on the roof 13 of the home 12 by a mounting assembly which is generally indicated by the numeral 30. The mounting assembly has a pair of vertically disposed posts 31, which each has a first end 32 that mounts a suitably dimensioned base plate 33. Each base plate is affixed in an appropriate fashion, using conventional fasteners, on the supporting surfaces 15 of the shakes 14. The pair of vertically disposed posts each has a second end 34 which receives and supports in a substantially horizontal attitude a rectangularly shaped frame 35. The rectangularly shaped frame has a pair of longitudinally disposed frame members 36, and a pair of transversely disposed frame members 37, which are interconnected to form the rectangular frame which supports the apparatus on the roof of the home. The longitudinally disposed frame members and the transversely disposed frame members each has a supporting surface 38.

As best illustrated by reference to FIGS. 4 and 5, the apparatus 10 is disposed internally of a rectangularly shaped housing which is generally indicated by the numeral 40. The housing has a first end 41 and an opposed second end 42. For purposes of illustrative convenience, it will be understood that the housing has a longitudinal axis 43 and an oblique axis 44. A base member 50 is mounted, using an appropriate fastener, not shown, on the supporting surface 38 of the rectangularly shaped frame 35. The base member has a supporting surface 51 and a peripheral edge generally indicated by the numeral 52. Mounted on the supporting surface 51 and extending in a substantially normal, sealable secure attitude, with respect to the peripheral edge 52, is a longitudinally disposed inside wall 53, and an outside wall 54. The inside wall 53 has an interior surface 60, an exterior surface 61, and a top edge 62. Positioned in an attitude closely adjacent to the first end 41 of the housing 40 and formed in the inside wall 53, is a substantially rectangularly shaped air discharge port 63. The air discharge port 63 is dimensioned to receive in slidably secure mating relation the discharge air duct 21 which interconnects the apparatus 10 in fluid-flow communication with the conditioned space.

Formed in a position approximately centrally along the inside wall 53 is a substantially rectangularly shaped return air port 64. The return air port 64 is adapted to receive in secure mating relation the return air duct 24 operably to interconnect the apparatus 10 with the conditioned space. The outside wall 54 has an interior surface 70, an exterior surface 71, and a top edge 72. Formed in an attitude substantially centrally of the outside wall 54 and in registry with the return air port 64, is a rectangularly shaped air intake port 73. Closely adjacent to the air intake port and positioned in spaced relation to the base member 50 is a water intake port 74.

Mounted on the base member 50 in an attitude substantially transversely related to the longitudinal axis 43, and interconnecting the inside and outside walls 53 and 54, respectively, is a first end wall 80, and an opposite second end wall 81. The first end wall 80 has an inside surface 82, an outside surface 83, and a top edge 84. Similarly, the second end wall has an inside surface 90; an outside surface 91; and a top edge 92. Formed in the second end wall and positioned in an appropriate attitude substantially centrally thereof are first and second rectangularly shaped exhaust ports 93 and 94, respectively.

Disposed in a substantially horizontal, covering attitude and in predetermined parallel spaced relation to the base member 50 is a top surface or cover generally indicated by the numeral 100. The cover 100 has an inside surface 101, an outside surface 102, an inside longitudinal edge 103, and an outside longitudinal edge 104. Affixed in predetermined spaced relation along the inside longitudinal edge, and on the exterior surface 61 of the inside wall 53, is a pair of hinges 105. As should be appreciated, the pair of hinges 105 permits the cover 100 pivotally to be urged out of engagement with the longitudinally disposed inside and outside walls, and the first and second end walls 80 and 81 to permit an operator to repair, replace, or maintain the various components of the apparatus which will hereinafter be discussed in greater detail. It should also be understood that the housing 40, thus defines an internal chamber 106, which substantially encloses the apparatus 10 of the subject invention. Formed in the cover 100, in an attitude closely adjacent to the first end 41 of the housing, is a substantially circular shaped orifice 107 which permits a vent to extend therethrough. The vent will hereinafter be described in greater detail.

Mounted substantially centrally of the housing 40 and extending in a normal attitude with respect to the supporting surface 51 of the base 50 are first and second transversely mounted partitions or walls 110 and 111, respectively. Attached to and extending between the first and second partitions 110 and 111, is a horizontally mounted wall 112. The horizontally mounted wall 112 has a supporting surface 113, and defines a space 114. Formed in both the first and second partitions 110 and 111 are suitably dimensioned orifices 115 and 116. Defined between the first partition and the inside surface 90 of the second end wall 81 is a first reservoir 120 which is adapted to receive a predetermined volume of water 121 having a reduced temperature. Mounted in fixed spaced relation to the second partition 111 are third and fourth transversely mounted partitions or walls 122 and 123. The fourth partition 123 has a top edge 124. Defined between the third and fourth partition is a second reservoir 125 which is adapted to receive a predetermined volume of water 126. The second reservoir receives in sealably secure relation a water intake pipe 127, which supplies water from a suitable source, not shown, to the second reservoir.

Figure 7:
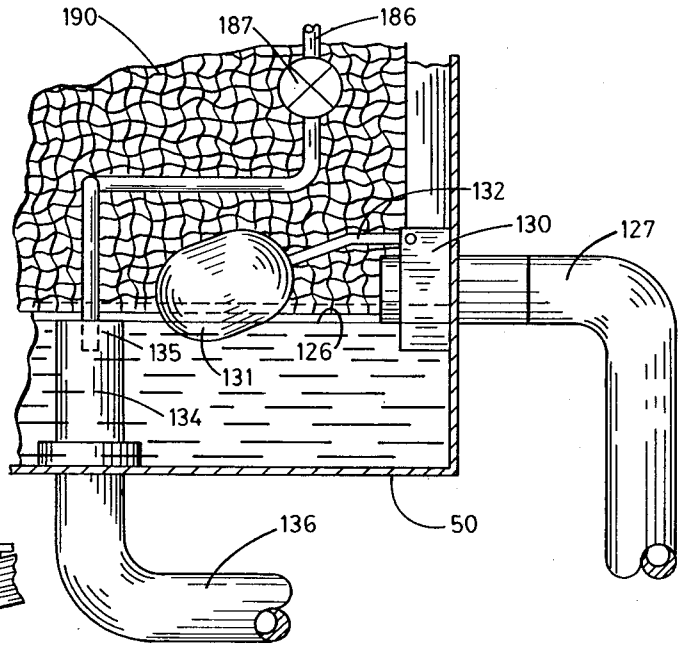
FIG. 7 is a somewhat enlarged, fragmentary, transverse, vertical section taken on line 7—7 in FIG. 4.

Mounted within the second reservoir 125 on the water intake pipe 127 is a valve 130, shown in FIG. 7, which meters water received in the intake pipe 127 in predetermined amounts to the second reservoir 125. The valve is actuated by a float assembly 131 which has a pivotally mounted arm member 132. The valve and float assembly cooperate in a manner familiar to those skilled in the art to maintain a preselected water level within the second reservoir. Interconnecting the first and second reservoirs 120 and 125, in fluid transferring relation is a conduit 133. The conduit permits water to flow between the first and second reservoirs for the purpose of supplying or otherwise stabilizing the amounts of water 121 and 126 contained in the first and second reservoirs. The conduit 133 extends through the orifices 116 to provide such fluid communication through the conduit while being sealed thereabout to avoid leakage. The second reservoir mounts a drain assembly 134 which extends in sealably secure relation through the base member 50 to maintain a maximum depth of water in the first and second reservoir. As should be appreciated, the drain assembly receives water through a proximal end 135 thereof and disposes of the water externally of the housing 40 through a distal end 136.

Figure 4:
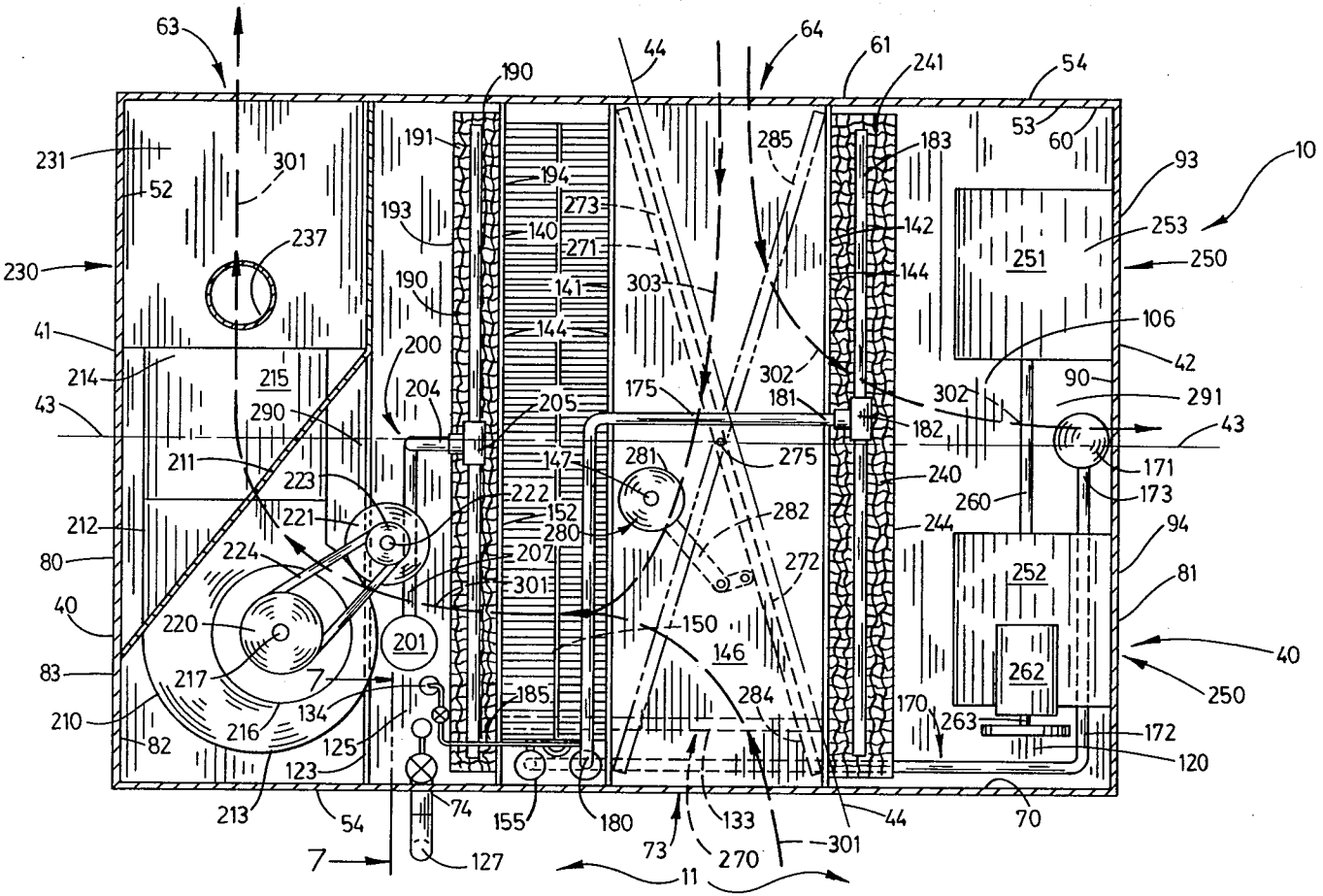
FIG. 4 is a horizontal section of the apparatus taken on line 4—4 in FIG. 1.
Figure 5:
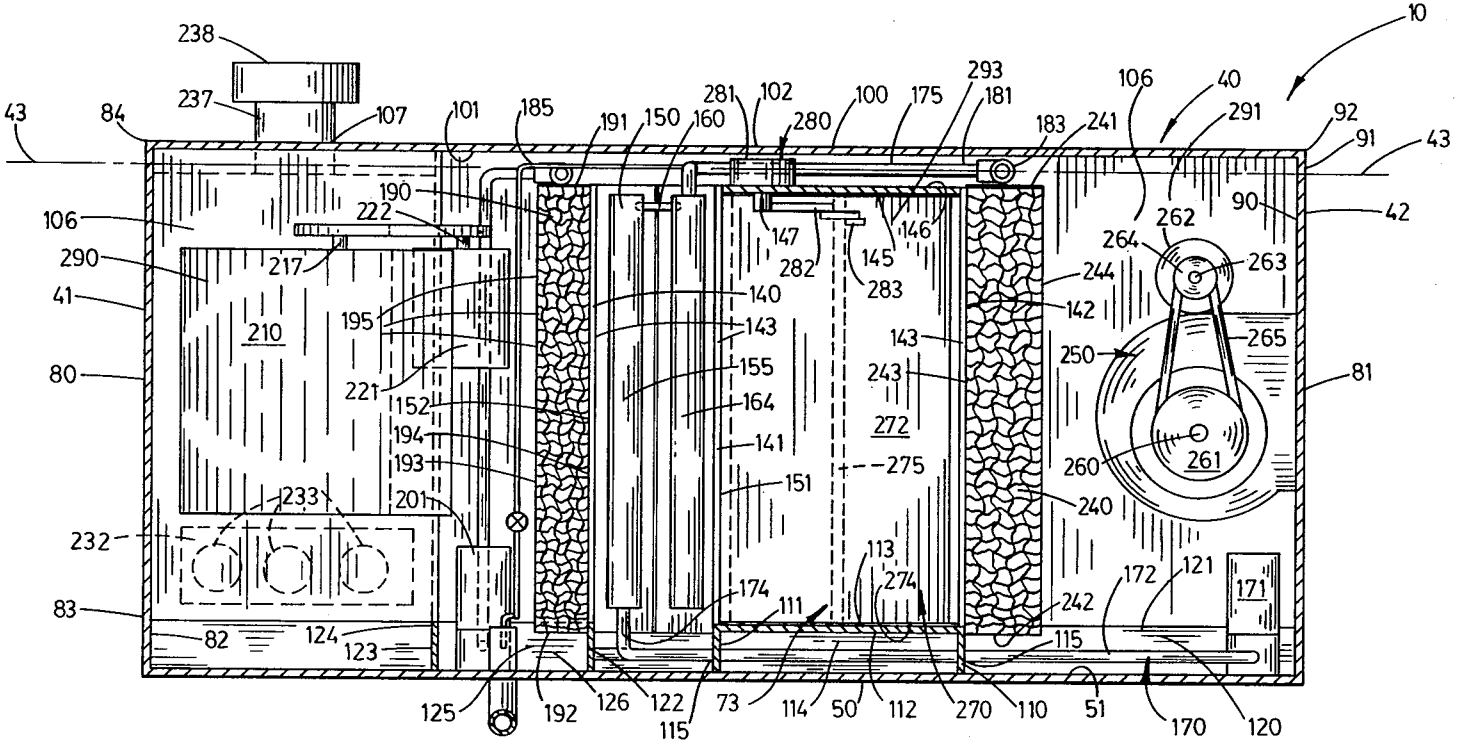
FIG. 5 is a longitudinal, transverse, vertical section of the apparatus taken on line 5—5 in FIG. 3.

As shown in FIGS. 4 and 5, first, second and third rectangularly shaped mounting assemblies, indicated by the numerals 140, 141, and 142, respectively, are mounted on the housing 40 internally of the chamber 106, and are oriented in transverse attitudes with respect to the longitudinal axis 43 of the housing 40. Each of the rectangularly shaped mounting assemblies has a pair of vertically disposed border frame members 143, and a pair of horizontally disposed border frame members 144, which are interconnected together to form the rectangularly shaped mounting assemblies. Mounted on and extending between the second and third rectangularly shaped mounting assemblies is a horizontally disposed wall 145 which is positioned in fixed, substantially parallel spaced relation to the cover 100 of the housing 40. The horizontally disposed wall 145 has a supporting surface 146 which has formed therein, at a predetermined location, an orifice 147.

Figure 6:
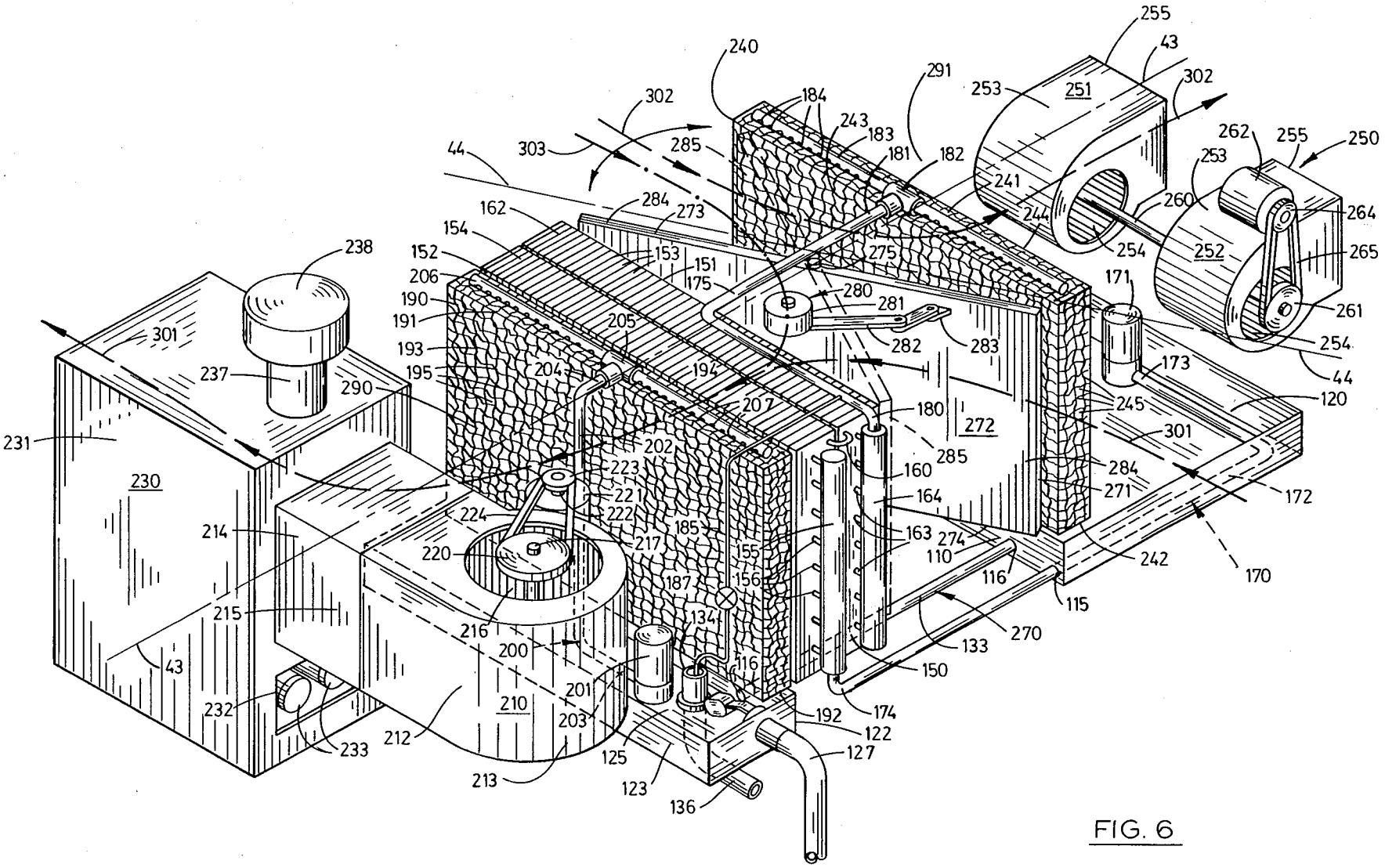
FIG. 6 is a perspective view of the apparatus of FIG. 1 with the housing and other supporting surfaces removed for illustrative convenience.

As shown in FIGS. 5 and 6, a water-to-air heat exchanger with counter-flow characteristics herein illustrated as a counter-flow heat exchanger 150 is mounted in the housing in a substantially transverse attitude with respect to the longitudinal axis 43 of the housing 40, to receive water 121 which has a reduced temperature from the first reservoir 120. The heat exchanger 150 is of conventional configuration having an outside surface 151, which is mounted in substantially facing mating engagement with the second rectangular mounting assembly 141, and an inside surface 152 which is mounted in substantially facing mating engagement with the first substantially rectangular mounting assembly 140. As should be understood, the heat exchanger defines a multiplicity of air passageways 153 which interconnect in fluid-flow relation the outside surface 151 with the inside surface 152. The heat exchanger has a first portion 154 which is adapted to receive the water 121 having a reduced temperature, through a first manifold 155. Extending in fluid transferring relation from the first manifold is a plurality of conduits 156 which traverse through the heat exchanger in a preselected pattern in a manner well understood in the art. A linking conduit 160 interconnects in fluid transferring relation the first portion 154 with a second portion 162. The second portion also contains a plurality of conduits 163 which are interconnected in fluid transferring relation with a second manifold 164.

As best understood by a study of FIG. 6, a first water distributor, which is generally indicated by the numeral 170, is adapted to deliver the water 121 having a reduced temperature from the first reservoir 120 to the bottom of the first manifold 155. The first water distributor has a pump 171 which withdraws the water having a reduced temperature from the first reservoir and delivers it to a first conduit 172 which interconnects the pump and the first manifold in fluid transferring relation. The first conduit has a proximal end 173 which is connected to the pump and a distal end 174 which is connected to the bottom of the first manifold. The first water distributor mounts a second conduit 175, which has a first end 180 that is connected in a fluid transferring relation to the top of the second manifold 164. The second conduit also has a second end 181, which is suitably connected to a T-shaped joint 182.

Extending in a substantially transverse attitude to the longitudinal axis 43, of the housing 40, is a horizontally disposed spray manifold 183. The spray manifold 183 has a plurality of horizontally disposed orifices 184 which have a small dimension; the spray manifold delivering a substantially equal volume of water 121 to substantially the entire surface of the cooling tower pad which will hereinafter be described in greater detail. Connected in fluid transferring relation to the second conduit 175 is a bleeding line 185 that interconnects the second conduit and the drain assembly 134 in fluid transferring relation. As best seen by reference to FIG. 7, the bleeding line has a distal end 186 which suitably mounts a shut off valve 187.

Disposed transversely of the longitudinal axis 43 of the housing 40 and mounted in substantially facing mating engagement with the heat exchanger 150, is a hydroscopic matrix media cooling pad 190. The matrix media cooling pad is of conventional configuration and is well understood in the art. The matrix media cooling pad has a top edge 191, and an opposed bottom edge 192; the bottom edge being mounted in fixed, spaced relation to the base member 50, of the housing 40, and in fluid transferring relation to the second reservoir 125. The matrix media cooling pad 190 further has an inside surface 193 and an outside surface 194 which is mounted in facing engagement with the first substantially rectangular mounting assembly 140. This relationship is best seen by reference to FIG. 5. The matrix media cooling pad 190 has a multiplicity of air passageways 195.

As shown in FIG. 6, a second water distributor 200 has a pump 201, which is disposed internally of the second reservoir 125, and which withdraws a predetermined volume of water 126 from the second reservoir for the purpose of pumping it through a conduit 202 to the top edge 191 of the matrix media cooling pad 190. The conduit 202 has a first end 203, which is interconnected in fluid transferring relation to the pump 201 and a second end 204, which suitably mounts a T-shaped joint 205. The T-shaped joint mounts a spray manifold 206 which is transversely disposed to the longitudinal axis 43 of the housing 40. The spray manifold 206 has a plurality of horizontally disposed orifices 207 that have a small dimension. The spray manifold 206 delivers substantially equal amounts of water withdrawn from the second reservoir to the entire surface of the matrix media cooling pad. The water delivered to the top edge of the matrix media cooling pad travels downwardly over the matrix media cooling pad to be received back into the second reservoir.

Figure 2:
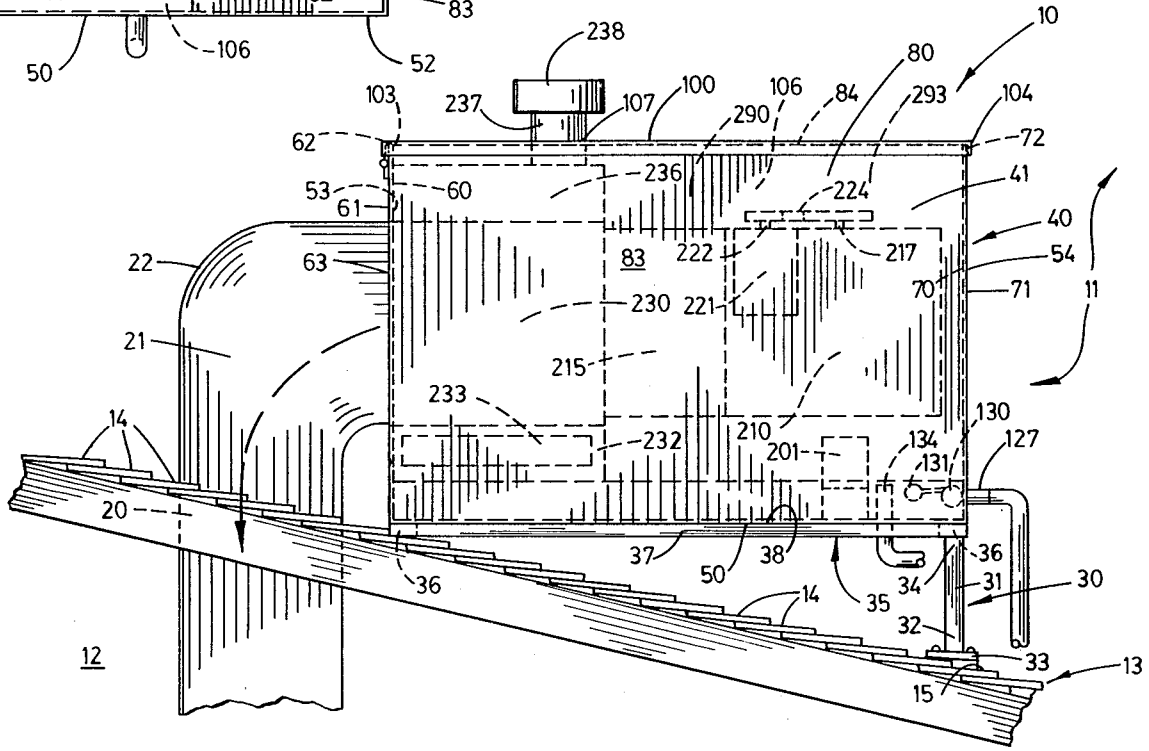
FIG. 2 is a side elevation of the apparatus of the present invention as viewed from the right in FIG. 1 and showing the apparatus in a typical operative environment and further showing the gas heater and the first air mover thereof in hidden lines.
Figure 3:
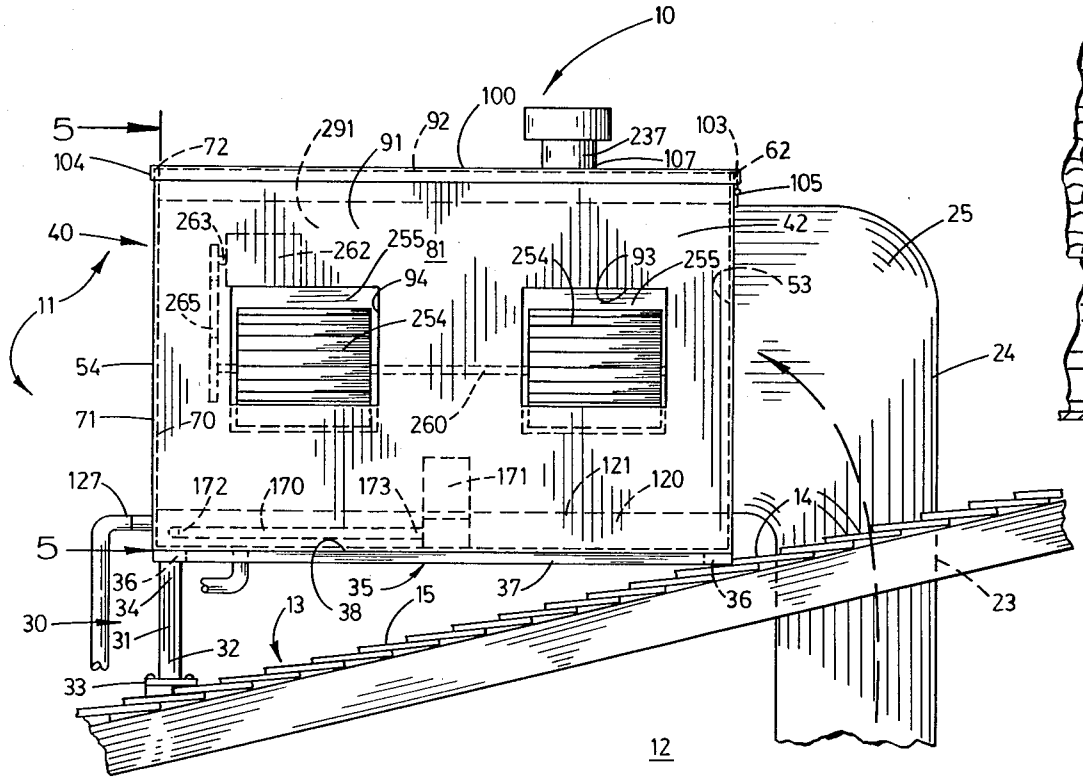
FIG. 3 is a side elevation of the apparatus opposite to that illustrated in FIG. 2, and showing the second air mover thereof in hidden lines.

As shown in FIGS. 2 and 4, a first air mover 210 is mounted in fixed, spaced relation to the matrix media cooling pad 190 and in a closely adjacent attitude to the first end 41 of the housing 40. The first air mover is held in fixed, spaced relation to the base member 50 by the diagonally mounted support member 211. The first air mover has a housing 212, which has a proximal end 213 and an opposite distal end 214. The housing defines an air passageway 215. Positioned in an appropriate attitude about the proximal end 213, is a fan assembly generally indicated by the numeral 216. The fan assembly is of assembly generally indicated by the numeral 216. The fan assembly is of conventional configuration and is well understood in the art. It should be appreciated that the first air mover can take on a number of different configurations and therefore the subject invention should not be limited to that which is disclosed. The fan assembly is rotatably deployed at the proximal end by a substantially vertically disposed axle 217 that mounts a suitably dimensioned pulley 220. Mounted on the housing 212 of the first air mover 210 is an electric engine or motor 221 which is electrically connected to a suitable source of electric energy, not shown. The electric motor has a shaft 222 which mounts a suitably dimensioned drive pulley 223. Extending about and between the pulley 220 and the drive pulley 223 in driving relation is a V-belt 224.

As shown in FIGS. 1 and 6, an efficient gas heater 230 or the like, is disposed at the first end 41 of the housing 40, and is connected in fluid communication with the first air mover 210. The gas heater has a housing 231 and a lower portion 232, which suitably deploys in a substantially horizontal attitude, a plurality of gas burner elements 233. The housing 231 defines an air passageway 234 which has mounted therein a multiplicity of vertically oriented vanes 235. The vanes receive heat energy produced by the gas burner elements 233 for the purpose of imparting that same heat energy to the ambient air 11 which is being urged through the air passageway 234. The housing 231 further has a top portion 236 which collects the various fumes produced as a byproduct of the heater elements 233, and releases these fumes through a vent 237 which extends therethrough the orifice 107 which is formed in the top surface or cover 100, to the surrounding atmosphere. It should be understood that the gas burner elements are connected to a source of gas and have a control means therefor, not shown. The vent 237 is also fitted with a hood 238 which prevents precipitation, foreign matter, or other debris from entering the vent from the outside environment.

A cooling tower pad 240 is mounted internally of the housing 40 in parallel, spaced relation to the heat exchanger 150. The cooling tower pad, which can be manufactured out of substantially the same material as the matrix media cooling pad 190, has a top edge 241, and a bottom edge 242 which is held in spaced relation to the base member 50 by the third rectangular mounting assembly 142. As best understood by a study of FIG. 5, the cooling tower pad is held in fluid communication with the first reservoir 120; thus it should be appreciated that the water 121 delivered by the transversely disposed spray manifold 183 to the top edge 241 travels over the cooling tower pad to be received back into the first reservoir. The cooling tower pad has an outside surface 243, an inside surface 244, and a plurality of air passages generally indicated by the numeral 245. The outside surface 240 is affixed in secure mating engagement to the third rectangular mounting assembly 142.

A second air mover, generally indicated by the numeral 250, is affixed to the second end 42 of the housing 40, about the inside surface 90 of the second end wall 81. The second air mover has a first element 251 and a second element 252. Each element has a housing 253 that mounts a rotatable fan assembly 254. Each housing 253 further defines an air passageway 255, which communicates with the first and second rectangular exhaust ports 93 and 94, respectively. Interconnecting the rotatable fan assemblies 254 is a common axle 260, which mounts a pulley 261. Mounted in an appropriate attitude to the exterior surface of the fan housing 253 which is most closely adjacent to the pulley 261, is an electric motor 262, is connected to a suitable source of electrical energy, not shown. The electric motor has a shaft 263 which mounts a drive pulley 264. The drive pulley mounts a V-belt 265 which transmits energy from the electric motor to the common axle 260 to urge the fan assemblies 254 to rotate.

Extending substantially transversely of the longitudinal axis 43 and positioned centrally of the housing 40 is a conduit or air passageway 270. The air passageway 270 extends between the counter-flow heat exchanger 150 and the cooling tower pad 240. The air passageway 270 operates, as will hereinafter be described to interconnect the source of ambient air 11 and the conditioned space of the home 12. The air passageway is bounded vertically in the housing by the horizontally disposed walls 112 and 145 to extend a substantial portion of the distance between the base member 50 and the cover 100 of the housing. The air passageway extends through suitable openings in the inside and outside walls 53 and 54, respectively, into communication with the ambient air on both sides of the housing.

The air directing damper 271 is mounted in the air passageway 270 for pivotal movement between the positions shown in phantom lines in FIG. 4. The damper has a rigid panel 272 which has a top edge 273 and a bottom edge 274. Affixed substantially centrally of the rigid panel is an axle 275 which is mounted for pivotal movement on and extending between the walls 112 and 145 in suitable bearings to mount the panel and thus the damper for pivotal movement in the air passageway 270 between the positions shown in phantom lines in FIG. 4.

As shown in FIGS. 5 and 6, a damper control assembly 280 is mounted on the upper, supporting surface 146 of the wall 145. The damper control assembly has a remotely controlled electric motor or solenoid assembly 281, which is affixed to the supporting surface, and which mounts an arm assembly 282 which extends through the orifice 147 of the wall 145 into the air passageway, as can best be seen in FIGS. 5 and 6. The arm assembly is affixed, by an attachment bracket 283, on the rigid panel 272 at a position closely adjacent to the top edge 273 thereof. The damper control assembly 280 is operable, by any suitable control system or mechanism not constituting part of the subject invention, to move the damper between a cooling position 284 shown in full lines in FIG. 6 and a heating position 285 shown in phantom lines in FIG. 6. When deployed in the cooling position, the damper is fixed in an attitude which is substantially parallel to the oblique axis 44 of the housing 40, and when it is deployed in the heating position the damper is positioned in an attitude oblique to the oblique axis of the housing.

During the operation of the apparatus 10, the first and second air movers 210 and 250, respectively, create a first reduced pressure zone 290 and a second reduced pressure zone 291. As shown in FIG. 4, the first reduced pressure zone is disposed in close proximity to the first end 41 of the housing 40, and the second reduced pressure zone is disposed in close proximity to the second end 42. As best illustrated in FIG. 6, the first and second reduced pressure zones are spatially separated internally of the housing by the air passageway 270 and the damper 271 internally thereof.

The damper 271 is adapted, selectively, to direct the ambient air 11 into a plurality of paths of travel hereinafter to be described. When the damper is in the cooling position 284, the first air mover 210, and the second air mover 250, in operation create first, second, and third paths of travel 301, 302 and 303 for the ambient air 11. The first reduced pressure zone 290 has the effect of urging the ambient air to enter into the apparatus 10 from an area of relatively high pressure externally of the housing 40 and into the first reduced pressure zone. As the ambient air enters the housing, it is directed into contact with the counter-flow heat exchanger 150 by the damper 271 and thus caused to follow the first path of travel 301. As the ambient air enters into the air passageway 270, it passes through the counter-flow heat exchanger at a substantially normal attitude with respect to the outside surface 151 thereof. The ambient air 11 thereafter passes through the hydroscopic matrix media cooling pad 190 and enters into the housing 212 of the first air mover 210. The ambient air, which has now been treated, is thereafter expelled through the air passageway 234 of the gas heater 230 and through the discharge air duct 21 into the conditioned space internally of the home 12. As shown in FIG. 4, the first path of travel extends between the air intake port 73 and the air discharge port 63. The first path of travel 301 thus has a substantially Ogee or "S" shaped configuration.

With the damper 271 in the cooling position 284, the treated air returning from the conditioned space of the home 12 enters into the return air duct 24 and travels into the housing 40 through the return air port 64. Upon entering the housing, the damper 271 directs the treated air along the second path of travel 302 which extends between the return air port 64 and the exhaust ports 93 and 94, respectively. The treated air moves through the cooling tower pad 240 in the second path of travel substantially normal to the plane thereof in response to the creation of the second reduced pressure zone 291. As best understood by a study of FIGS. 4 and 6, the second path of travel for the treated air is characterized by a substantially hyperbolic shaped configuration, when viewed in plan view, until it is drawn in to the second air movers and expelled from the housing 40 through the air passageways 255 thereof.

As discussed earlier, the damper control assembly 280 is operable to urge the damper 270 from a cooling position 284, to a heating position 285. When the damper is deployed in the heating position 285, a third path of travel 303 is created. The third path of travel, which is defined between the return air port 64 and the air discharge port 63, is characterized, when viewed in plan view, by a substantially parabolic shape. When the damper is deployed in the heating position, only the first air mover 210 and the gas heater 230 are operational; all other components of the apparatus 10 are deactivated during the heating of the ambient air.

OPERATION

The operation of the described embodiment of the subject invention is believed to be readily apparent and is briefly summarized at this point.

The apparatus 10 of the subject invention has two main distinct phases of operation, a heating phase and a cooling phase. For illustrative convenience, the two phases will be discussed separately.

COOLING PHASE OF OPERATION

During the cooling phase of operation, the damper 271 is deployed by the remotely controllable damper control assembly 280 in the cooling position 284. In this position, the damper directs ambient air 11 into the housing 40 along the first path of travel 301. To cause the ambient air 11 to enter into the housing 40 through the air intake port 73, the first air mover 210 is actuated to create the first reduced pressure zone 290. The ambient air 11 thus travels from a source of high pressure exterior to the housing 40 and into the first reduced pressure zone.

The pump 171, which is a component element of the first water distributor 170, withdraws water 121 having a reduced temperature from the first reservoir 120 and pumps it through the conduit 172. The water withdrawn from the first reservoir enters into the counter-flow heat exchanger 150 through the first manifold 155. As the source of ambient air 11 travels to the first reduced pressure zone 290, it passes through the counter-flow heat exchanger 150, and is thereby permitted to give up sensible heat to the water 121 that is coursing through the counter-flow heat exchanger. When this occurs, there is a simultaneous reduction in the ambient air's dry and wet bulb temperatures, and an increase in the water's 121 sensible heat. Therefore, the water 121 exiting out of the second manifold 164 has an elevated temperature. The water having an elevated temperature thereafter travels to the transversely disposed spray manifold 183 and is discharged therefrom through the plurality of orifices 184.

After the ambient air 11 travels through the counter-flow heat exchanger 150, it next passes into contact with the matrix media cooling pad 190. The matrix media cooling pad is supplied with water 126 from a second reservoir 125. As the ambient air passes through the plurality of air passages 195, formed in the matrix media cooling pad, the water 126 is caused to be evaporated into the ambient air nearly saturating it with moisture and thus decreasing its dry bulb air temperature still further. It should be understood, therefore, that the ambient air upon leaving the matrix media cooling pad, has now become a volume of treated air having a reduced dry and wet bulb temperature. The first air mover 210 thereafter expels the treated air out of the apparatus 10 where it is carried to the conditioned space of the home 12. Within the conditioned space, the treated air circulates to absorb heat and thereby to cool the conditioned space.

As can best be imagined by a study of FIG. 4, the apparatus 10 of the subject invention can be adapted to incorporate conventional air conditioning components for the purpose of extending the operational climatic range of the subject invention. More particularly, it should be understood that an air conditioning evaporator, not shown, can be deployed in a position along the first path of travel 301 between the first air mover 210 and the matrix media cooling pad 190; and the air conditioner condenser coil, not shown, can be deployed along the second path of travel 302 between the second air mover 250 and the cooling tower pad 240.

The second air mover 250 creates a second reduced pressure zone 291 which has the effect of urging the treated air, which has been provided to the conditioned air space, to enter into the return air duct 24 and travel to the housing 40. As the treated air enters into the housing, it is directed by the damper 271 along the second path of travel 302. The transversely disposed spray manifold 183 delivers the water 121 having an elevated temperature, in substantially uniform amounts, over the cooling tower pad 240; the water having an elevated temperature traveling over the cooling tower pad giving up to the treated air moving in the second path of travel 302 a predetermined amount of sensible heat to produce the water 121 that has a reduced temperature that is received back into the first reservoir. As should be understood, the treated air leaving the conditioned space has absorbed sensible heat from the surroundings, and is therefore no longer in a saturated state. In the process of passing through the cooling tower pad, both sensible and evaporative cooling is imparted to the water having an elevated temperature traveling over the cooling tower pad. After the treated air has moved through the cooling tower pad, it is expelled out of the apparatus 10 through the first and second rectangular exhaust ports 93 and 94, respectively. As should be appreciated, any water that has evaporated or otherwise been bled off is replenished by means of the float assembly 131 which activates the valve 130 which thereafter meters a predetermined volume of water into the second reservoir 125.

HEATING PHASE OF OPERATION

The apparatus 10 of the subject invention can also be utilized as a heater for the conditioned space. During the heating phase of operation, a number of the components of the apparatus do not operate. Those inoperative in the heating phase are the second air mover 250 and the first and second water distributors 170 and 200. Moreover, if the apparatus has conventional air conditioning components, these would similarly be inactive. During the heating phase of operation, the damper 271 is deployed in the heating position 285 to direct the treated air, coming from the conditioned space, along the third path of travel 303. The first air mover 210 creates the first reduced pressure zone 290 which urges the treated air to move from a source of high pressure; that is, the conditioned space; to the first reduced pressure zone. Upon entering into the first low pressure zone, the treated air is propelled into the gas heater 230 through the air passageways 215. As the treated air moves through the air passageway 234, heat energy is imparted to the treated air to produce an elevated temperature. The treated air thereafter passes into the conditioned space. This heating cycle continues for a preselected period of time and is controlled remotely by a thermostatic device or the like, not shown, which is located in the conditioned space.

While the above-described operative modes constitute what are believed to be the two main modes, other modes of operation are also possible. For example, the second water distributor 200 and the matrix media cooling pad can be employed, if desired, to impart moisture to the treated air passing therethrough in the heating phase of operation. Another alternative is in the cooling phase of operation not to operate these components so as to produce relatively dryer cooled air. A still further variation is in either of the foregoing variations to operate these components only at reduced capacity thereby modifying only partially the two main modes of operation.

The apparatus for treating air of the present invention achieves operational efficiency by employing treated air as the source of precooling energy for a source of water which is thereafter provided to a counter-flow heat exchanger. The apparatus minimizes energy consumption by accommodating heat and mass transfer elements which possess large cross-sectional areas which minimize flow area constrictions and changes in direction thus reducing to a minimum the pressure drops in the air flow which in prior art devices requires significantly greater energy consumption, such as of the electricity for powering the air movers therewithin, to produce a given operative effect. Therefore, the apparatus for treating air of the present invention can be employed in a wide variety of operative environments, can be manufactured and purchased at moderate cost, is highly efficient in operation and is compact facilitating installation and maintenance, and reduces to an absolute minimum the problems associated with evaporative and other types of cooling devices.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. An apparatus for treating air comprising a housing having opposite ends, an axis, and an air passageway, having a pair of boundaries, which extends substantially transversely of the axis, a heat exchanger transversely mounted in the housing and disposed along one of said boundaries of the air passageway for removing heat from air passed therethrough, an air mover mounted adjacent to one end of the housing operable to draw air through said heat exchanger for delivery to a service area, an evaporative cooler medium disposed between the air mover and the heat exchanger, and means for supplying a fluid to the evaporative cooler medium for imparting moisture to the air drawn through said heat exchanger by the air mover; a second evaporative cooler medium disposed in parallel spaced relation to the heat exchanger, the second evaporative cooler medium transversely mounted in the housing and disposed along the boundary of the air passageway opposite to the boundary along said heat exchanger for receiving air drawn into the housing through the air passageway from the service area, a pivotally positionable damper mounted substantially centrally of the air passageway and operable selectively to direct air entering into the passageway along a pair of paths of travel individually through said heat exchanger and the second evaporative cooler medium; a second air mover mounted adjacent to the end of the housing opposite to that adjacent to the first air mover operable to draw air from the service area through the second evaporative cooler medium; and a fluid system, including said supplying means, interconnecting the second evaporative cooler medium in fluid receiving relation, the heat exchanger in fluid supplying relation and the second evaporative cooler medium in fluid supplying relation whereby fluid in the second evaporative cooler medium is cooled by air drawn from the service area pushing through the second evaporative cooler medium and said fluid is delivered to the heat exchanger to absorb heat from said air passed therethrough and said fluid is then returned to the second evaporative cooler medium.

2. An apparatus for treating air comprising:

a housing having opposite ends and an internal chamber defining an axis with a passageway disposed substantially centrally of the housing and extending transversely of the axis, the passageway communicating with a source of said air and with an area to be conditioned;

a pair of air movers individually mounted at the opposite ends of the housing for creating two reduced pressure zones in the chamber;

a pivotally positionable damper mounted in the passageway for directing the air along a pair of paths of travel individually through said reduced pressure zones;

means transversely mounted in the chamber individually adjacent to said reduced pressure zones and the passageway for absorbing heat from the air passing along one of said paths of travel to said area to be conditioned and for dissipating said absorbed heat from air passing along the other of said paths of travel from the area to be conditioned; and means mounted in the housing for evaporatively cooling the air passing along the path of travel to the area to be conditioned.

3. The apparatus of claim 2 wherein the absorbing means is a water-to-air heat exchanger having counter-flow characteristics and the evaporative cooling means is a cooling pad.

4. The apparatus fo claim 3 including a selectively operable heater mounted in communication with the path of travel to said area to be conditioned and wherein the damper can be pivoted to a heating position closing said paths of travel and establishing a third path of travel extending into communication with the heater and interconnecting at its opposite ends the area to be conditioned.

5. The apparatus of claim 3 wherein the housing has a fluid system including two reservoirs containing fluid the first of which is in the second reduced pressure zone in fluid receiving relation to said heat dissipating means and is connected through the fluid system in fluid supplying relation to the water-to-air heat exchanger for absorbing sensible heat energy from the air moving therethrough and thereby elevating the temperature of said fluid, the fluid system interconnects the heat exchanger with said heat dissipating means to supply said fluid of elevated temperature to said heat dissipating means and said second reservoir is in the first reduced pressure zone and is connected by the fluid system to supply fluid to said evaporative cooling means for evaporation into the air moving therethrough to reduce the temperature of the air passing to the area to be conditioned.

6. The apparatus of claim 5 wherein said fluid system has a pump disposed internally of the first reservoir to withdraw fluid from the first reservoir and deliver it through the fluid system and a pump is disposed internally of the second reservoir to withdraw the fluid contained therein and the fluid system is connected to the top edge of the heat dissipating means for gravitational distribution of said fluid therethrough.

7. The apparatus of claim 6 wherein said evaporative cooling means is a mtrix media cooling pad and the heat dissipating means is a cooling tower pad.

8. The apparatus of claim 6 wherein the heater can be selectively activated when the damper is in the heating position and the fluid system is deactivated.

9. The apparatus of claim 6 wherein the water-to-air heat exchanger is a counter-flow heat exchanger.

10. An apparatus for treating air having a housing with a longitudinal axis and first and second ends, the apparatus comprising:

a passageway extending through the housing and positioned substantially centrally and transversely of the longitudinal axis, the passageway interconnecting a source of relatively dry air and a space to be conditioned;

a pivotally positionable damper mounted internally and substantially centrally of the passageway for diverting air received from said source in a predetermined direction internally of the passageway;

a water-to-air heat exchanger mounted in the housing adjacent to the passageway and disposed in a substantially transverse attitude to the longitudinal axis of the housing, the heat exchanger receiving water from a first reservoir circulated internally of the heat exchanger;

a matrix media cooling pad disposed in facing engagement with the heat exchanger and receiving water from a second reservoir which passes gravitationally over the cooling pad to be received back into the second reservoir;

a first air mover mounted in spaced relation to the matrix media cooling pad at the first end of the housing, the first air mover adapted to draw air from the source into the passageway for direction by the damper through the heat exchanger and the matrix media cooling pad to release heat to the water received by the heat exchanger and the matrix media cooler pad thereby to reduce the dry and wet bulb temperature of the air for delivery to the space to be conditioned;

a cooling tower pad mounted internally of the housing in juxtaposition to the passageway and in parallel spaced relation to the water-to-air heat exchanger, the cooling tower pad adapted to receive water having an elevated temperature from the heat exchanger flowing thereover for receipt in the first reservoir;

a second air mover mounted in spaced relation to the cooling tower pad at the second end of the housing, the second air mover operble to draw air from the space to be conditioned into the passageway for direction by the damper through the cooling tower pad to absorb heat from the water passing thereover thereby reducing the temperature of the water; and first and second water distributors operable individually to deliver water to the matrix media cooling pad and to the cooling tower pad respectively, said first water distributor withdrawing water from the first reservoir and the second water distributor withdrawing water from the second reservoir.

11. The apparatus of claim 10 wherein the air moving to and the air moving from the space to be conditioned move in predetermined first and second paths of travel internally of the housing in closely adjacent attitudes separated from each other by the damper.

12. The apparatus of claim 11 wherein the first path of travel extends from an outside air intake port of the housing to a discharge air port in the housing and the second path of travel extends between an inside air intake port and an exhaust port in the housing.

13. The apparatus of claim 12 wherein the first and second paths of travel extend through the housing in substantially opposite directions.

14. The apparatus of claim 13 wherein the first path of travel is substantially ogee shaped and the second path of travel is substantially hyperbolic in shape.

15. The apparatus of claim 11 wherein the first and second paths of travel have cross-sectional areas which are substantially constant throughout their lengths.

16. The apparatus of claim 10 wherein the first and second water distributors each have a spray manifold, the individual spray manifolds connected in fluid receiving relation to pumps disposed internally of the first and second reservoirs respectively for withdrawing water from the first and second reservoirs and pumping it to the individual spray manifolds.

17. The apparatus of claim 16 wherein the matrix media cooling pad and the cooling tower pad each have an exterior surface and the individual spray manifolds deliver water in substantially equal amounts to the entire exterior surfaces of the matrix media cooling pad and the cooling tower pad.

18. The apparatus of claim 11 wherein a heater is mounted in the housing in communication with the first path of travel.

19. The apparatus of claim 18 wherein the damper has a cooling position and a heating position and in the heating position defines a third path of travel interconnecting the space to be conditioned and the heat exchanger and closes the first and second paths of travel.

20. The apparatus of claim 11 wherein the water-to-air heat exchanger is a counter-flow heat exchanger.

* * * * *

UNITED STATES PATENT AND TRADEMARK OFFICE

CERTIFICATE OF CORRECTION

PATENT NO. : 4,726,197

DATED : February 23, 1988

INVENTOR(S) : Dennis L. Megrditchian

It is certified that error appears in the above-identified patent and that said Letters Patent is hereby corrected as shown below:

Column 14, line 18, "pushing" should read -- passing --.

Column 15, line 17, "mtrix" should read -- matrix --.

Signed and Sealed this

Second Day of August, 1988

*Attest:*

DONALD J. QUIGG

*Attesting Officer*

*Commissioner of Patents and Trademarks*